United States Patent [19]

Morrison

[11] Patent Number: 4,712,246

[45] Date of Patent: Dec. 8, 1987

[54] PUPPET SPEAKER

[76] Inventor: Alberta J. Morrison, P.O. Box 246, Eureka, Nev. 89316

[21] Appl. No.: 681,894

[22] Filed: Dec. 14, 1984

[51] Int. Cl.[4] ..... G06F 3/02

[52] U.S. Cl. ..... 381/77; 446/302; 381/88

[58] Field of Search ..... 381/77, 79, 81, 82, 381/88, 90; 446/327, 299, 302; 179/146 E, 146 H, 157

[56] References Cited

U.S. PATENT DOCUMENTS

| | | | |
|---|---|---|---|
| 1,652,839 | 12/1927 | Smith | 446/302 |
| 1,660,594 | 2/1928 | Bruckner | 446/302 |
| 1,931,236 | 10/1933 | Nicolson | 179/146 H |
| 2,966,550 | 12/1960 | Goldberg | 381/77 |
| 3,384,074 | 5/1968 | Rautiola | 179/146 H |
| 4,516,950 | 5/1985 | Berman | 446/327 |
| 4,540,176 | 9/1985 | Baer | 446/327 |

FOREIGN PATENT DOCUMENTS

| | | | |
|---|---|---|---|
| 560620 | 9/1957 | France | 179/146 H |
| 2029715 | 3/1980 | United Kingdom | 446/302 |

*Primary Examiner*—Gene Z. Rubinson
*Assistant Examiner*—L. C. Schroeder

[57] ABSTRACT

A hand held speaker designed for use with a puppet and an ordinary cassette player, to give any puppet a voice.

The device comprises a speaker uniquely enclosed in a fabric cover and attached to a four component telephone cable assembly. This assembly has an in-line, rotary off-on switch and both a speaker plug and a remote control plug.

It is separate from, and can be used with, any puppet. It is to be held in the user's palm, inside the puppet, as the puppet is manipulated. The in-line, rotary on-off switch allows the puppet voice to be stopped or started at will, to allow the user to speak.

The device is particularly designed for use by an unskilled person or child, for the purpose of presenting a puppet performance easily and in a natural manner.

1 Claim, 8 Drawing Figures

PUPPET SPEAKER

BACKGROUND OF THE INVENTION

1. Field of the Invention

The present invention relates to a hand held speaker to be used in any puppet to produce a desired audio output. It has a remote on-off switch which controls the source of the sound. This enables the operator to proceed as desired by interjecting the puppet's recorded voice, by means of this speaker plugged into the "earphone" or "speaker" jack and the "remote control" jack on a cassette player.

2. Description of the Prior Art (Background Art)

Puppet presentations require memorizing dialogue for both the puppet and the puppeteer. It is also necessary to effect a different "voice" for the puppet. It is also difficult to speak for the puppet without moving your mouth. These problems make it very difficult for most people to perform puppet skits.

Toys having a speaking function have appeared on the market. They normally have a permanent, fixed speaker with a very limited speaking function. Some are so complicated the average person could not operate it. They clearly are not applicable to the easy performance of a series of current puppet skits. Examples are described in U.S. Pat. No. 2,029,7150 and in U.S. Pat. No. 1,660,594. Also UK Pat. No. 2,029,715A.

SUMMARY

The present invention seeks to provide a speaking apparatus which is extemely easy to operate and whose operation is readily performed by a child.

The present invention seeks to provide a simple and inconspicuous means of providing a voice for any puppet.

Further in accordance with an embodiment of the invention, the speaker is not attached to the toy and can therefore be used in any puppet.

Additionally, in accordance with the preferred embodiment of the invention, the imput means includes a four component cord with a remote on-off, rotary, in-line switch, which allows the operator to cause the puppet to pause in a conversational manner, while he speaks his own portion of the script.

The present invention is for use with an ordinary cassette player.

Further, in accordance with the preferred embodiment of the invention, the puppeteer can, by use of an ordinary cassette player, record additional scripts and cause the puppet to speak these recorded scripts.

In the preferred embodiment of the invention, the speaker is held in the operators palm, inside the puppet and is plugged into the earphone or speaker, jack and the remote control jack of an ordinary cassette recorder, player.

Further in accordance with the embodiment of the invention, the speaker may be placed inside a toy without an operator. With the cord plugged into the speaker jack on the tape recorder, player, the puppet can provide songs, speech or any pre-recorded material, for use as a bed time companion for children.

Additionally in accordance with the embodiment of the invention, the puppet can appear to tell all about the animal it represents, by means of the appropriate cassette being played on a cassette player.

Further in accordance with an embodiment of the present invention a puppet can become a convincing and entertaining learning device.

DESCRIPTION OF THE PREFERRED EMBODIMENT

Figure 8:
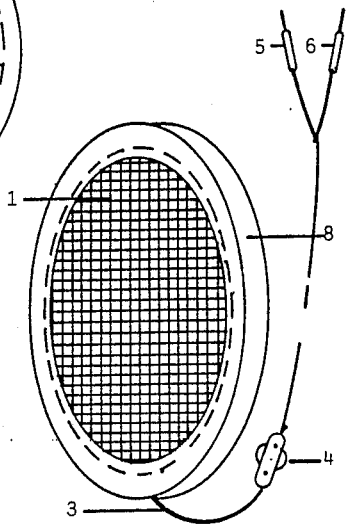
FIG. 8 shows the completed Puppet Speaker.

Reference is now made to FIG. 8 which illustrates the Puppet Speaker constructed and operative in accordance with the preferred embodiment of the present invention.

The Puppet Speaker comprises a semi-rigid grill 1, a speaker 2, telephone cable 3, a switch 4, and plugs 5 and 6. It has a cardboard barrier 7, padding 10, and a napped fabric cover 8, secured by a strong cord 9.

The grid 1, is a semi-rigid plastic mesh screen corresponding in size to the size of the speaker 2. The speaker grid 1, is fastened to the speaker 2, with adhesive. The speaker 2, may be a $2\frac{1}{4}$ in. 8-ohm, or a 3 in. 8-ohm replacement speaker. Two wires of the four component telephone cable 3, are soldered to the terminals of the speaker 2, FIG. 3. The other end of the two wires are connected to the miniature phone plug 5. The remaining two wires of the four component telephone cable 3, are attached to the in-line, miniature off-on rotary switch 4, and to the sub-mini plug 6, to be plugged into a remote control jack. The back of the speaker 2, is protected by a circle of light weight cardboard 7, perforated by a $\frac{7}{8}$ inch hole FIG. 4.

Figure 1:
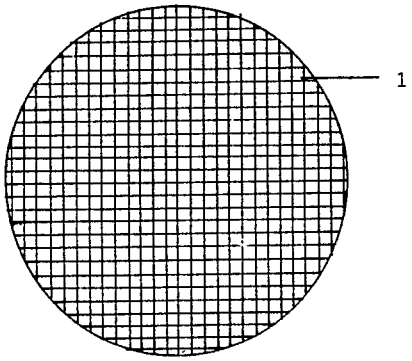
FIG. 1 is the plastic mesh, semi rigid, screen, speaker grill.
Figure 2:
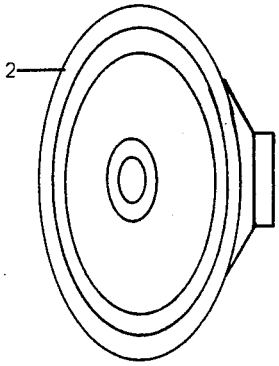
FIG. 2 is the $2\frac{1}{4}$ in. or 3 in. 8-ohm replacement speaker.
Figure 3:
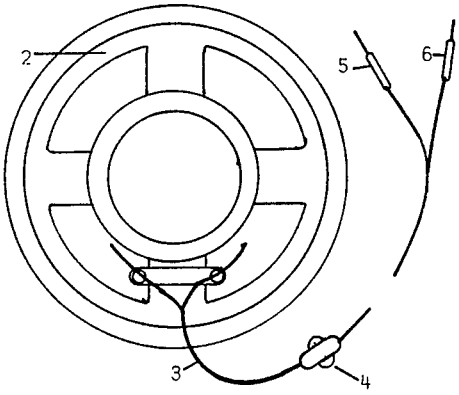
FIG. 3 shows the four component telephone cable, 3, attached to speaker 2, rotary off-on switch 4, and miniature phone plug 5, and sub-mini remote plug 6.

According to the preferred embodiment of the present invention, the speaker 2, with attached grid 1, and telephone cord 3, attached to speaker terminals FIG. 3, and with the back of the speaker 2, covered by protective cardboard circle 7, is now referred to as the assembled speaker.

Figure 4:
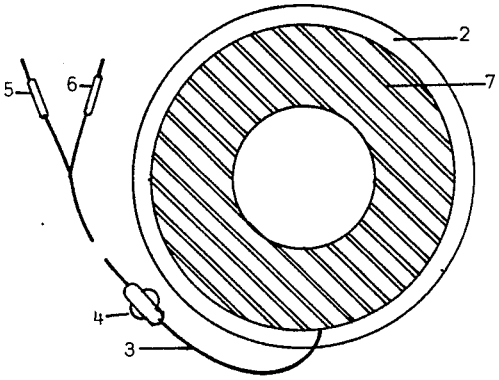
FIG. 4 shows a cardboard circle 7, over back of speaker 2.
Figure 5:
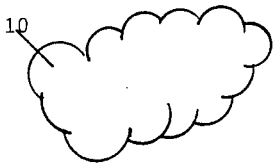
FIG. 5 is a small amount of fiberfill padding.
Figure 6:
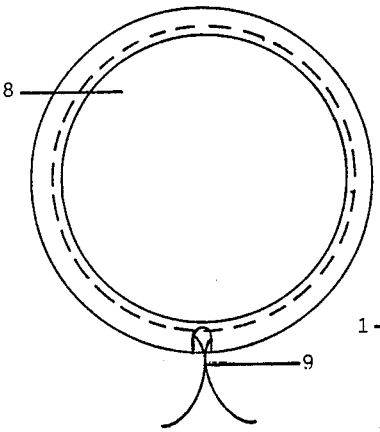
FIG. 6 shows a circle of heavy napped fabric 8, with a stitched edge, forming a channel to accomidate heavy cord 9.
Figure 7:
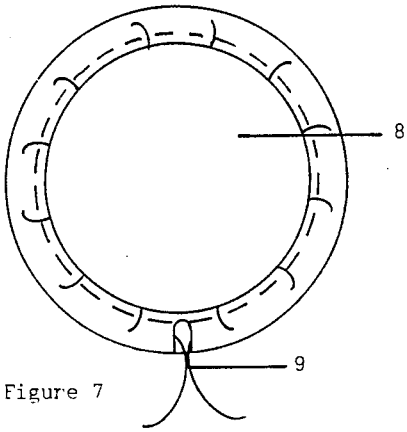
FIG. 7 shows the fabric 8, gathered by the cord 9, to accommodate padding 10, and speaker assembly, FIG. 3.

In accordance with the preferred embodiment of the invention, the cover for the assembled speaker FIG. 4, is made by folding in and stitching a hem around the outer edge of the circle of heavy napped fabric 8, FIG. 6. This forms a channel for the heavy cord 9. The cord 9, is pulled, forming a pouch, FIG. 7. The pouch is padded by inserting the polyester padding 10. According to the preferred embodiment of the present invention, the assembled speaker body FIG. 4, is fitted into the padded fabric pouch 8. The cord 9, is pulled tight and fastened securely, allowing the telephone cable 3 to exit under the knot, allowing the switch 4, and plugs 5 and 6 to extend FIG. 8.

It is a particular feature of the present invention, that use of the in-line, off-on switch allows the operator to cause the puppet to speak or stop speaking at will, to allow interaction with the audience and to add his own dialogue.

It is a particular feature of the present invention that it is interchangable, allowing use in any puppet.

It may also be appreciated that the operator can use his own individually prepared cassettes and therefore is not limited to a commercially prepared module, disk or mechanism.

Thus, it should be apparent that the preferred embodiment of the present invention will provide an unskilled person or child with a device with which he can make the puppet perform easily and in a natural manner.

I claim:

1. A speaker apparatus for use in a hand puppet comprising:

a speaker of a size capable of being held in one palm of a person while operating a hand puppet, a housing for said speaker comprising padding means covering the rear side of said speaker, a fabric material covering said padding means, and a semi-rigid, audio-transparent plastic grill attached to said speaker and covering the front side of said speaker, a four-wire telephone cable having a first two wires connected at a first end of said cable to input connectors of said speaker, a second two wires of said cable being connected at the first end of said cable to an in-line rotary on/off switch, the first two wires being connected at a second end of said cable to a miniature plug for connection to the audio output of an audio signal source and said second two wires being connected at said second end of said cable to a subminiature plug for connection to a remote control port of said audio signal source.

* * * * *